US011828122B2

(12) United States Patent
Pye

(10) Patent No.: US 11,828,122 B2
(45) Date of Patent: Nov. 28, 2023

(54) PUMP DOWN PIPE SEVERING TOOL

(71) Applicant: SAUDI ARABIAN OIL COMPANY, Dhahran (SA)

(72) Inventor: Richard Mark Pye, Aberdeen (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/096,103

(22) Filed: Nov. 12, 2020

(65) Prior Publication Data

US 2022/0145715 A1 May 12, 2022

(51) Int. Cl.

| | |
|---|---|
| ***E21B 23/02*** | (2006.01) |
| ***E21B 23/08*** | (2006.01) |
| ***E21B 29/00*** | (2006.01) |
| ***E21B 17/10*** | (2006.01) |
| ***E21B 47/09*** | (2012.01) |
| *E21B 43/114* | (2006.01) |

(52) U.S. Cl.
CPC ..... *E21B 29/005* (2013.01); *E21B 17/1078* (2013.01); *E21B 23/02* (2013.01); *E21B 47/09* (2013.01); *E21B 23/08* (2013.01); *E21B 43/114* (2013.01)

(58) Field of Classification Search
CPC ..... E21B 23/08; E21B 29/00; E21B 43/114
See application file for complete search history.

(56) References Cited

U.S. PATENT DOCUMENTS

| | | | |
|---|---|---|---|
| 3,782,459 | A | 1/1974 | Murray |
| 6,564,868 | B1 | 5/2003 | Ferguson et al. |
| 7,575,056 | B2 | 8/2009 | Fuhst et al. |
| 10,119,349 | B2 | 11/2018 | Umphries et al. |
| 10,458,204 | B2 | 10/2019 | Churchill |

(Continued)

FOREIGN PATENT DOCUMENTS

| | | | |
|---|---|---|---|
| GB | 2288350 | A | 10/1995 |
| WO | 2020/006333 | A1 | 1/2020 |

OTHER PUBLICATIONS

International Search Report and Written Opinion of the International Searching Authority issued in corresponding International Application No. PCT/US2021/059113 dated Feb. 7, 2022 (14 pages).

*Primary Examiner* — Robert E Fuller
*Assistant Examiner* — Lamia Quaim
(74) *Attorney, Agent, or Firm* — Osha Bergman Watanabe & Burton LLP

(57) ABSTRACT

A pump down device is deployed at an anchor point in a pipe to perform a pipe severing operation. The pump down device includes: a cutting head positioned at one end of the pump down device that severs the pipe; one or more centralizers that are positioned adjacent to the cutting head and configured to provide friction for deployment of the pump down device at the anchor point and centralize the cutting head; a seal that is positioned near an end opposite to the one end of the pump down device; and an electronics housing that includes a plurality of electronic sensors. The pump down device releases an anchor mechanism upon reaching the anchor point as determined by the plurality of electronic sensors based on preprogrammed inputs. The seal prevents fluid from moving past the pump down device when in operation.

10 Claims, 8 Drawing Sheets

(56) References Cited

U.S. PATENT DOCUMENTS

| | | | | |
|---|---|---|---|---|
| 10,544,655 | B2 | 1/2020 | Churchill | |
| 2011/0146989 | A1* | 6/2011 | Dotson | E21B 43/114 166/298 |
| 2015/0233218 | A1* | 8/2015 | Myhre | E21B 43/114 166/281 |
| 2016/0305210 | A1* | 10/2016 | Flores | E21B 33/124 |
| 2017/0030156 | A1 | 2/2017 | Churchill | |
| 2017/0204703 | A1 | 7/2017 | Mair | |
| 2019/0284889 | A1* | 9/2019 | Lagrange | E21B 23/08 |
| 2020/0063512 | A1 | 2/2020 | Yan et al. | |

* cited by examiner

PUMP DOWN PIPE SEVERING TOOL

BACKGROUND

In the oil and gas industry, there are situations when a drill string becomes stuck downhole. Causes of stuck pipe may be due to geological issues where, for example, pressure downhole is significantly lower than drilling fluid being used. The stuck pipe prevents a drill rig from continuing operations, which results in costly downtime. In these situations when the pipe is unable to be pulled from the wellbore, there are some remedial operations possible to sever the drill string and to recover the unstuck portion of drill pipe. Existing methods to sever the pipe are blind back off, wireline free point and back off, and hydraulic severing using pump down darts and dedicated subs.

In the blind back off method, the driller estimates where the pipe is free from doing stretch tests. The string is then put into neutral tension/compression at a point above the estimated stuck point and then negative torque is wound in. It is hoped that the string will part at the connection targeted. However, there are disadvantages to this method, because the string may not part in the expected location.

In the wireline free point and back off method, a tool is run into the well on wireline and tests are carried out to determine the position where the string is stuck. An additional run is then required to take the severing tool to the required location above this point. However, there are disadvantages to this method, because the severing mechanism can use either explosives or chemicals that could potentially do harm to workers and the environment. In addition, in high angle wells the wireline will need to be pumped or tractored into place. Optionally, the severing operation can be done with a mechanical cutting tool on wireline powered from surface.

In the hydraulic severing method using pump down darts and dedicated subs, a sub or multiple dedicated dart receiver subs must always be run in the drill string at predetermined depths. When the pipe becomes stuck a dart of the required OD is dropped/pumped from surface and it lands in the selected sub. Flow from surface is then directed through the dart at the pin connection in the sub and after some time the erosion of the metal in the pin weakens it and the connection separates. However, there are disadvantages to this method, because the location of the cut has to be decided before drilling starts and the location of the subs is fixed once they go into the well which may not be the optimal position. Also, the 'fish' that remains will have a large OD (the special dart receiver sub connection) which may be difficult to get a fishing overshot onto in some hole sizes.

An improved method is needed to resolve the stuck pipe problem.

SUMMARY OF INVENTION

In general, in one aspect, embodiments disclosed herein relate to a pump down device that is deployed at an anchor point in a pipe to perform a pipe severing operation. The pump down device includes a cutting head positioned at one end of the pump down device that severs the pipe; one or more centralizers that are positioned adjacent to the cutting head and configured to provide friction for deployment of the pump down device at the anchor point and centralize the cutting head; a seal that is positioned near an end opposite to the one end of the pump down device; and an electronics housing that comprises a plurality of electronic sensors. The pump down device releases an anchor mechanism upon reaching the anchor point as determined by the plurality of electronic sensors based on preprogrammed inputs. The seal prevents fluid from moving past the pump down device when in operation.

In general, in one aspect, embodiments disclosed herein relate to a method for operating a pump down device that is deployed at an anchor point in a pipe to perform a pipe severing operation. The method includes pre-programming inputs to the pump down device; installing the pump down device in the pipe at surface; deploying the pump down device in the pipe by controlling a volume of fluid pumped, wherein the pump down device comprises a plurality of sensors associated with the pre-programmed inputs and an anchor mechanism triggered based on the pre-programmed inputs; setting the pump down device at a desired depth when the plurality of sensors match the pre-programmed inputs; determining the pump down device has deployed at the anchor point based on changes in surface pressure readings; channeling the fluid through the pump down device and out of a cutting head to sever the pipe; and retrieving the pump down device with the pipe.

BRIEF DESCRIPTION OF DRAWINGS

Specific embodiments of the invention will now be described in detail with reference to the accompanying figures. Like elements in the various figures are denoted by like reference numerals for consistency.

DETAILED DESCRIPTION

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Throughout the application, ordinal numbers (e.g., first, second, third) may be used as an adjective for an element (i.e., any noun in the application). The use of ordinal numbers is not to imply or create a particular ordering of the elements nor to limit any element to being only a single element unless expressly disclosed, such as by the use of the terms "before," "after," "single," and other such terminology. Rather the use of ordinal numbers is to distinguish between the elements. By way of an example, a first element is distinct from a second element, and the first element may encompass more than one element and may succeed (or precede) the second element in an ordering of elements.

The present disclosure relates to a tool for dealing with stuck pipe downhole that can be deployed quickly, can be set in any joint of drill pipe, does not require dedicated subs to provide a seat, can reach high angles and extended reach without the need to employ a wireline tractor, and does not use explosives or chemicals. In general, embodiments of the invention disclosed herein relate to an electromechanical tool/device that may be deployed from a surface into the inner diameter (ID) of a drill string and positioned at a depth within the wellbore that is selected by personnel at the rig site immediately prior to use. The device does not need be conveyed on wire (slickline, e-line, or wireline) or coil and does not require commands to be sent to it from surface once deployed (downlink) in order to activate at the required depth.

In embodiments disclosed herein, the terms "tool" and "device" may be used interchangeably to describe the pump down device that is the subject of this application.

Figure 1:
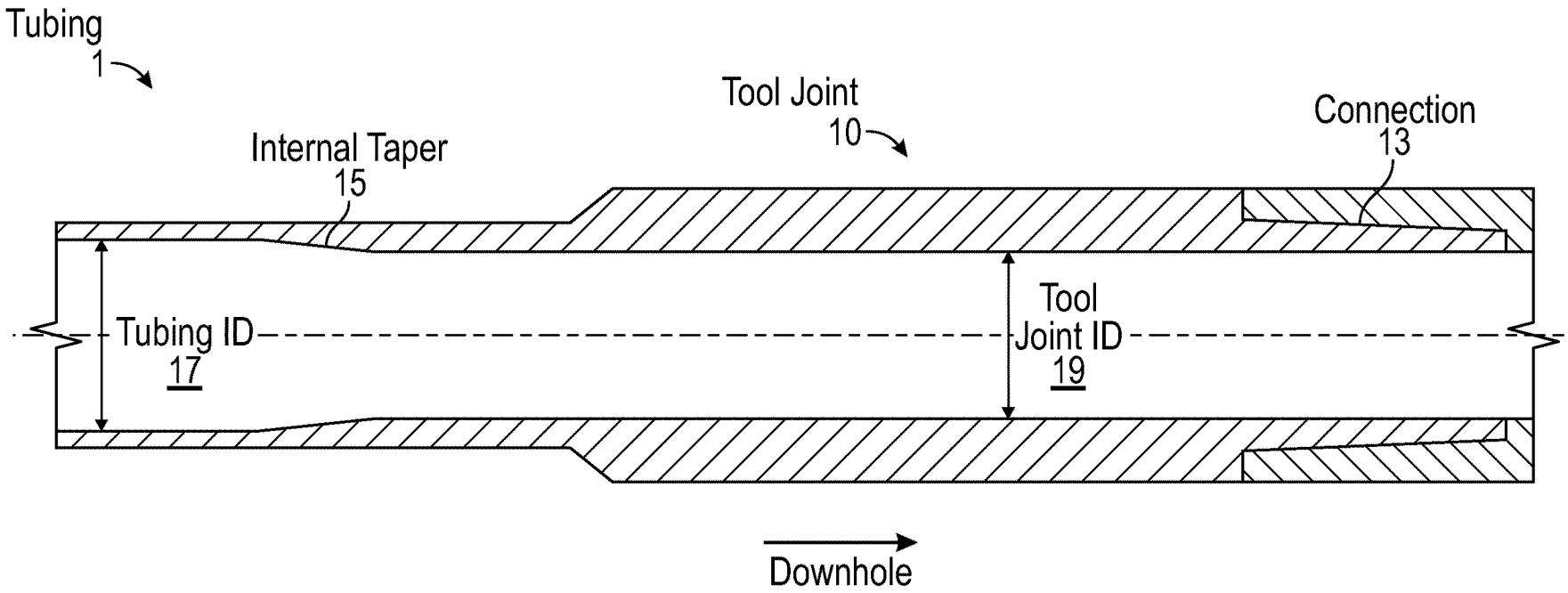
FIG. 1 shows a schematic drawing of a pipe in accordance with one or more embodiments.

FIG. 1 is a schematic drawing of a drill pipe tubing 1 in accordance with one or more embodiments. The tubing 1 is a hollow, thin-walled, steel or aluminum alloy piping that is used on drilling rigs. The tubing 1 is hollow to allow drilling fluid to be pumped down the hole through the bit and back up the annulus. In the tubing 1, there may be one or more joints, where each joint is connected to a next by means of a tool joint 10. The tool joint 10 is a threaded connection having typically a pin at the downhole end a box at an uphole end. The pin of the tool joint 10 and the box of the tool joint 10 are screwed together and torqued at surface.

In FIG. 1, the tubing 1 also includes an internal taper 15 in accordance with one or more embodiments. FIG. 1 shows the internal taper 15 relative to the tubing inner diameter (ID) 17 and tool joint ID 19. The internal taper 15 is the transition from the thin walled tubing to the thicker walled tool joint. For example, a pipe with 5½ inches outer diameter (OD) may have an ID 17 of 4.778 inches, and the tool joint 10 may have an OD of 7 inches, and an ID 19 of 4 inches. The connection 13 connects the tubing 1 to other tubing that are not shown.

Figure 2:
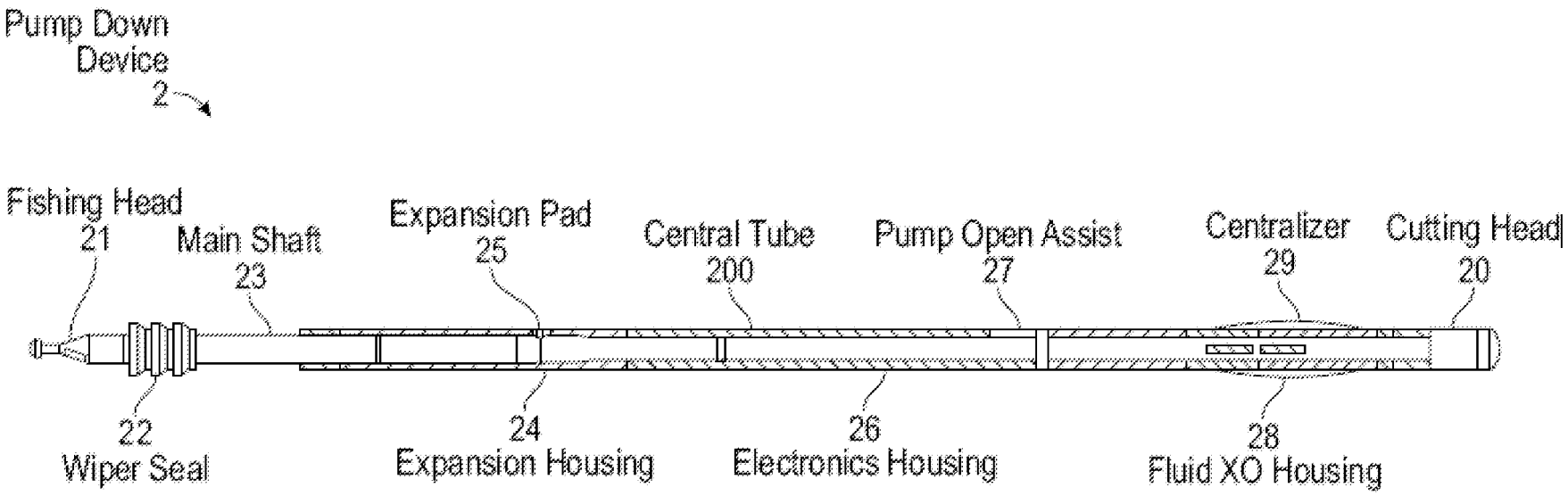
FIGS. 2 and 3 shows a pump down device inside a pipe in accordance with one or more embodiments.

In one or more embodiments, a pump down device 2 that is designed to fit inside the tubing 1, such as that shown in FIG. 1 is shown in FIG. 2. As shown in FIG. 2, the pump down device 2 has multiple components, and may include, at least, a fishing head 21, a wiper seal 22, a main shaft 23, an expansion housing 24, an expansion pad 25, an electronics housing 26, a pump open assist 27, a fluid cross-over (XO) housing 28, a centralizer 29, a cutting head 20. Each of these components is discussed in further detail below.

In one or more embodiments, the pump down device 2 may include a central tube 200. The central tube 200 runs through the entire length of the pump down device 2 which in its initial state is prevented from stroking the main shaft 23 by a retention mechanism controlled by the device electronics. The central tube 200 functions as a housing for all of the internal components of the pump down device 2. In other words, the central tube 200 is a tool housing into which all of the other main parts fit.

In one or more embodiments, the pump down device 2 may include a fishing head 21. The fishing head 21 is used to recover the pump down device 2 using wireline in the event that the pump down device 2 fails to cut the pipe or the pipe cannot be recovered after being cut. In a successful operation the pump down device 2 will be recovered with the severed pipe without the need for wireline.

In one or more embodiments, the pump down device 2 may include a wiper seal 22. The wiper seal 22 prevents fluid from moving past the pump down device 2 when in operation. The wiper seal 22 ensures that the pump down device 2 is able to be pumped into the well and is carried along at a same velocity as the fluid. In one or more embodiments, the outer diameter of the tool 2, not including the wiper seal 22 which is bigger, is smaller than the smallest restriction in the drill pipe that it is expected to pass through. In most cases this smallest restriction is a tool joint of the drill pipe.

In one or more embodiments, the pump down device 2 may include a main shaft 23. The main shaft 23 controls the opening of the expansion pad 25. The main shaft 23 also controls the fluid flow of the fluid cross-over housing 28. Specifically, when the main shaft 23 is at a locked state, the expansion pad 25 remains closed, and no fluid flow through the pump down device 2. When the main shaft 23 is at a stroked state, the expansion pad 25 is open, and fluid cross over flow through the pump down device 2.

Fluid is prevented from exiting the tool by the position of the central tube 200 relative to the body of the pump down device. When the preprogrammed sensors determine the pump down device 2 has reached the desired depth, the main shaft 23 is now able to stroke through the body of the pump down device 2, which pushes out the expansion pads 25 to increase the tool outer diameter preventing it from going through the next tool joint in the string and landing in the drill pipe internal upset. The stroking of the main shaft 23 is achieved by fluid flow exerting pressure on it. The downward motion of the tube locks the expansion pads 25 in place preventing them from retracting and also locks the main shaft 23 in place to prevent future unwanted upward movement and thus ensuring that the hydraulic cutting head 20 is maintained at a single depth.

In one or more embodiments, the pump down device 2 may include an expansion housing 24 that houses a plurality of expansion pads 25. The plurality of expansion pads 25 are located inside of the expansion housing 24, which are more clearly shown in FIGS. 4A and 4B. As described above, when the main shaft 23 is at a stroked state, the expansion housing 24 pushes out the plurality of expansion pads 25 to increase the outer diameter (OD) of the pump down device 2, thereby preventing the pump down device 2 from traveling further downhole through a next tool joint in the string, and landing in the drill pipe internal upset. In one or more embodiments, the expansion pads 25 include three pads with an interval of 120 degrees. With the expansion pads 25, it is possible for the pump down device to not land on any preinstalled anchor mechanism in the pipe and does not require a wire to reach the anchor point. In other words, the pump down device 2 can be pumped into the ID of a drill string and automatically anchor itself at the required depth and perform a pipe severing operation without surface intervention or control. The downward motion of the pump down device 2 locks the plurality of expansion pads 25 in place preventing them from retracting, and also locks the main shaft 23 in place to prevent future unwanted upward movement and thus ensuring that the cutter head 20 is focused on a single area.

In one or more embodiments, if the pump down device 2 fails to cut the pipe or needs to be removed, the pump down device 2 may be recovered using slickline or wireline. Pulling on the pump down device 2 may shear the lock open mechanism and the expansion pads 25 release with upwards movement.

In one or more embodiments, the pump down device 2 may be used in Heavy Weight Drill Pipe (HWDP) or other components where there is no internal upset for anchoring the pump down device 2, there exists an alternative method of securing the pump down device 2 in the tubing. In this instance, other mechanism that could secure the pump down device 2 in the tubing such as slips may need to be set. The pump down device 2 is pumped into the well as described above and the electronic sensors and circuitry may activate the tool at the prescribed depth.

In one or more embodiments, the pump down device 2 may include an electronics housing 26. The electronics housing 26 houses a number of sensors to monitor various parameters allowing the tool to be operated in a number of different ways depending on the specific application, and at least a processor that controls the sensors. For example, the sensors may include a time sensor, a magnetic sensor, a RFID reader, and/or a vibration sensor. The various kinds of sensors may be used in isolation or in combination with each other to achieve the required result. The different types of sensors and functions are explained in detail below. In addition, the electronics housing 26 may also house one or more batteries for powering the pump down device 2. More specifically, the tool/device 2 is powered by a battery or series of batteries.

In one or more embodiments, a timer circuit or time sensor may be installed in the electronics housing of the pump down device 2. The pump down device 2 may include a processor that is programmed to actuate an anchor mechanism (i.e., the plurality of expansion pads 25) after a period of elapsed pumping time has passed. More specifically, in one or more embodiments, the pump down device 2 is required to be pumped into the well (without the ability to freefall) by controlling the volume of fluid pumped. For example, knowing the internal volume of the drill pipe, the depth of the pump down device at any time may be determined by a simple vol/ft displacement calculation. Timing circuits may be coupled with vibration sensors in the pump down device 2 so that the timers are disabled if, for instance, something happens to the pumps during displacement as indicated by the vibrational response downhole and the operation needs to be halted.

A magnetic sensor is another example of a type of sensor that may be housed in the pump down device. In one or more embodiments, the pump down device 2 is able to identify drill pipe tool joints using this sensor as the tool joint is significantly bigger than the drill pipe tubing and has a larger magnetic field. It is therefore possible to choose the number of tool joints that the pump down device 2 must pass before releasing the anchor mechanism. The precise depth of operation may be chosen by preprogramming this sensor.

An RFID reader may alternatively or additionally be installed on the pump down device 2. For example, in one or more embodiments, various joints of the drill pipe may have the RFID tags embedded inside. The joints of the pipe may be strategically placed along the string to allow multiple possible locations for severing. The desired location for the pump down device is picked by choosing which joint of pipe containing the RFID tag (at the required depth) is to be used to trigger the anchor mechanism.

One or more vibration sensors may also be used in the pump down device 2. The action of pumping the pump down device 2 into the wellbore causes significant vibration. When the pumps are turned off after the required volume of fluid has been pumped, there may be less noise and the vibration sensor may sense the reduction in vibration, and release the anchor mechanism after a period of time has elapsed.

The sensors monitor various parameters allowing the tool to be operated in a number of different ways depending on the specific application. In one or more embodiments, each or all of the aforementioned types of sensors may be preprogrammed before the pump down device is sent downhole. Thus, by including a preprogrammed input that indicates a desired elapsed timing or depth, and installing a corresponding sensor selected from the above sensors, the pump down device 2 is able to intelligently determine when a correct depth has been reached in real-time. The desired depth within the wellbore may be selected by personnel at the rig site immediately prior to use of the pump down device 2. Alternatively, the pump down device may automatically determine, based on preprogrammed inputs received from a model or computer system such as that shown in FIG. 8, where to locate itself for the severing operation. The pump down device 2 may also include a combination of sensors selected from the above sensors. Upon determining that the correct depth is reached, the pump down device 2 releases the plurality of expansion pads 25 as the anchor mechanism to start the process of severing at the desired depth location.

Continuing with FIG. 2, in one or more embodiments, the pump down device 2 may include a pump open assist 27. In order for the main shaft 23 to stroke downwards relative to the tool body, it must overcome an internal friction within the tool. The centralizer 29 on the outside of the pump down device 2 provides more friction in an uphole direction than the internal components on the main shaft 23 in an downhole direction. Therefore, when the main shaft 23 is released by the electronics, it moves downwards. However, if the frictional forces are not thus, then the pump open assist 27 will stroke the pump down device 2 regardless. The pump open assist 27 consists of a valve and a piston area within the pump down device 2 (created between the main shaft OD and the tool outer housing ID). When the electronics releases the main shaft 23, a valve (perhaps using a solenoid or other actuating device) will also open to divert flow from the bore of the pump down device 2 to the piston chamber. The higher pressure of the fluid acting on the uphole piston side compared to the pressure on the downhole side will cause the main shaft 23 to stroke. There will be a pressure compensation port (hole) on the outside of the pump down device 2 which will also be where the displaced fluid exits so as not to hydraulically lock the pump down device 2 as it tries to open.

In one or more embodiments, the pump down device 2 may include a fluid cross-over housing 28.

As described above, when the main shaft 23 is locked, no fluid flows through the fluid cross-over housing 28. When the main shaft 23 is stroked, fluid flows through the cross-over housing 28 to the hydraulic cutting head 20.

In one or more embodiments, the pump down device 2 may include one or more centralizers 29, and a cutting head 20. The centralizers 29 provide friction on deployment and centralize the cutting head 20. The cutting head 20 may be a hydraulic cutting head that is configured to cut or sever any stuck pipe or other part of the drill string that needs to be pulled back up or otherwise disconnected from the remainder of the drill string or tubing (1, FIG. 1). Specifically, when the fluid flows to the cutting head 20, the cutting head channels fluid from axial to radial flow at a high velocity to erode the tubing wall at a thinnest point. Because the fluid flows at a high velocity, internal components of the cutting head 20 are made of erosion resistant metals or ceramics. In the process of severing the tubing wall, the centralizer 29 is required to keep the cutting head 20 in the middle of the bore and concentrate the fluid at one fixed depth. In one or more embodiments, the position of the pump down device 2 within the drill pipe is defined by the internal taper 15 which is the transition between the tubing inner diameter and the tool joint inner diameter and is the anchor point. The cutting head 20 is therefore placed at a fixed distance below the anchor point in the tubing of the joint below which has the thinnest wall thickness to cut on the joint of pipe.

The action of the pump down device 2 moving down opens ports within the pump down device 2 to facilitate flow through the pump down device 2 to the hydraulic cutting head 20.

In one or more embodiments if the pump down device 2 fails to cut/sever the portion of pipe that is stuck, or the device itself needs to be removed, the pump down device 2 may be recovered using slickline or wireline. Pulling on the pump down device 2 may shear the lock open mechanism latch and the anchor mechanism may be released with upwards movement.

Those skilled in the art will appreciate that the configuration of the pump down device 2 is not limited to that which is shown in FIG. 2. For example, components described above may be combined, or the pump down device may include other components not shown, such as pressure equalization ports, actuation latches, pins, or any other suitable feature for operation of the pump down device including anchoring of the device and severing of any stuck pipe.

Figure 3:
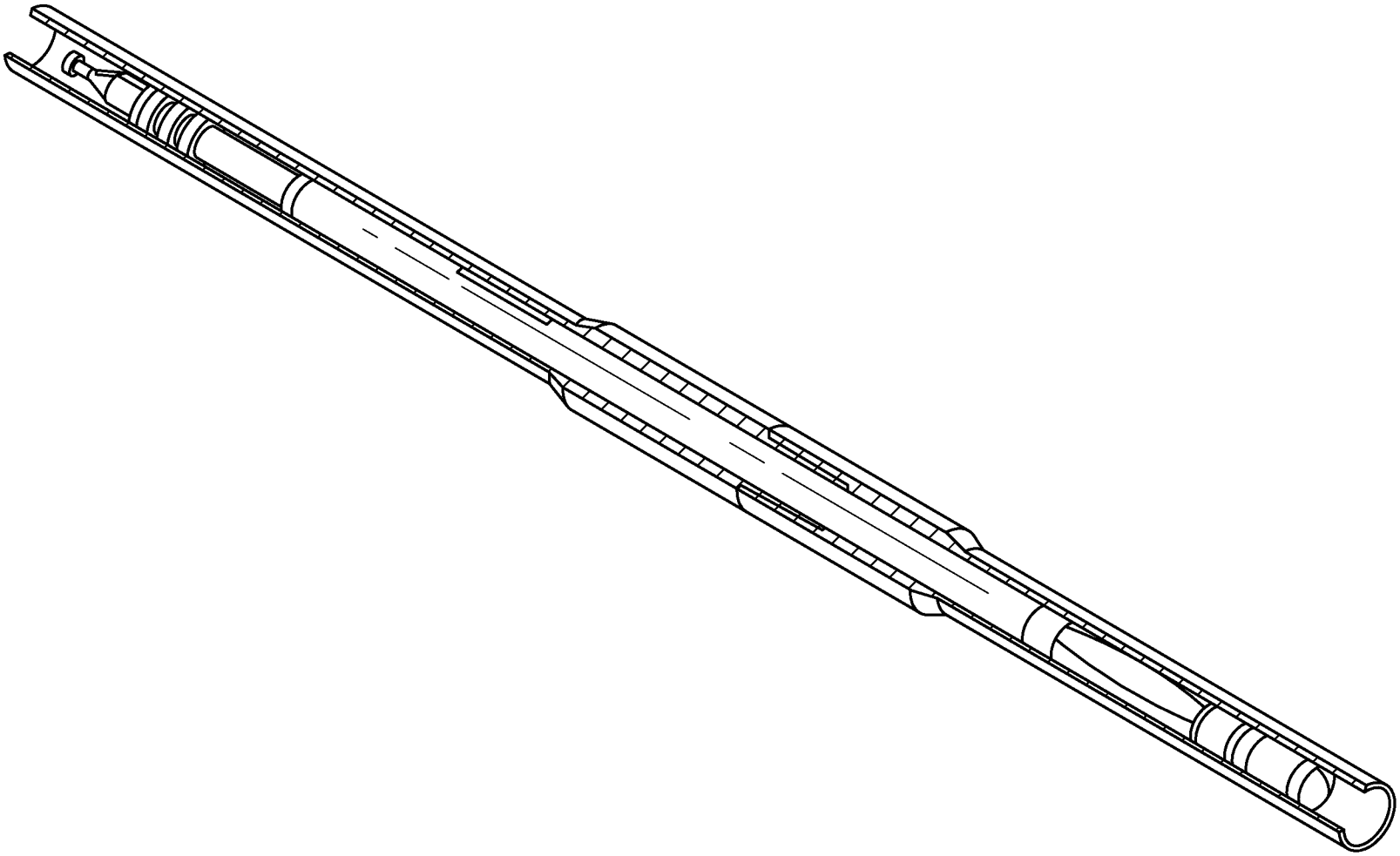

FIG. 3 is an embodiment showing the pump down device 2 anchored inside the tubing 1. As described above, in one or more embodiments, the outer diameter of the pump down device 2 (not including the seal) is configured to be smaller than the smallest restriction in the drill pipe (tubing) that it is expected to pass through. In the embodiment of FIG. 3, the pump down device 2 of FIG. 2 is shown anchored inside drill pipe tubing 1 of FIG. 1 with the cutting head located in a tool joint below. In the embodiment of FIG. 3, the pump down device 2 is anchored in the pipe, and the black rectangle at the taper location above the tool joint represents the pads or anchor device.

Figure 4A:
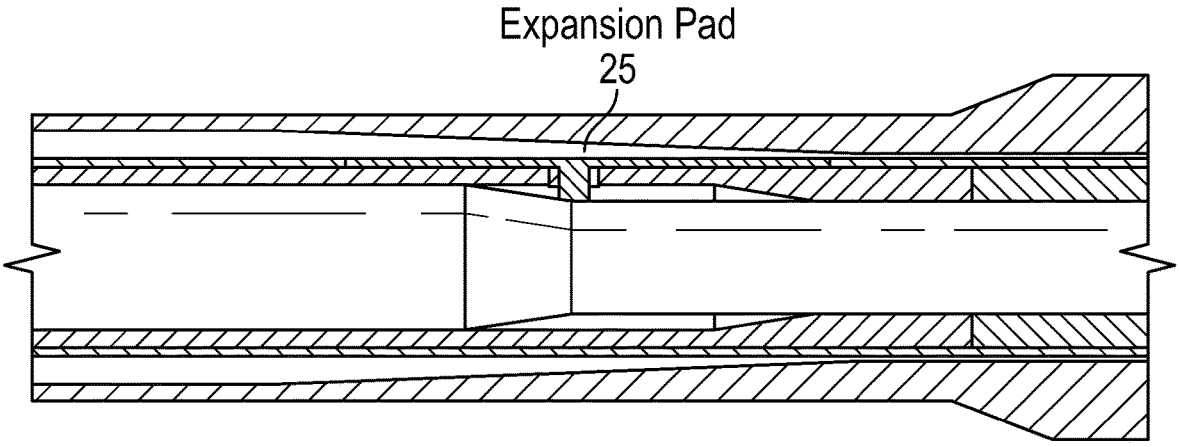
FIGS. 4A and 4B show two conditions of pads of a pump down device in accordance with one or more embodiments.
Figure 4B:
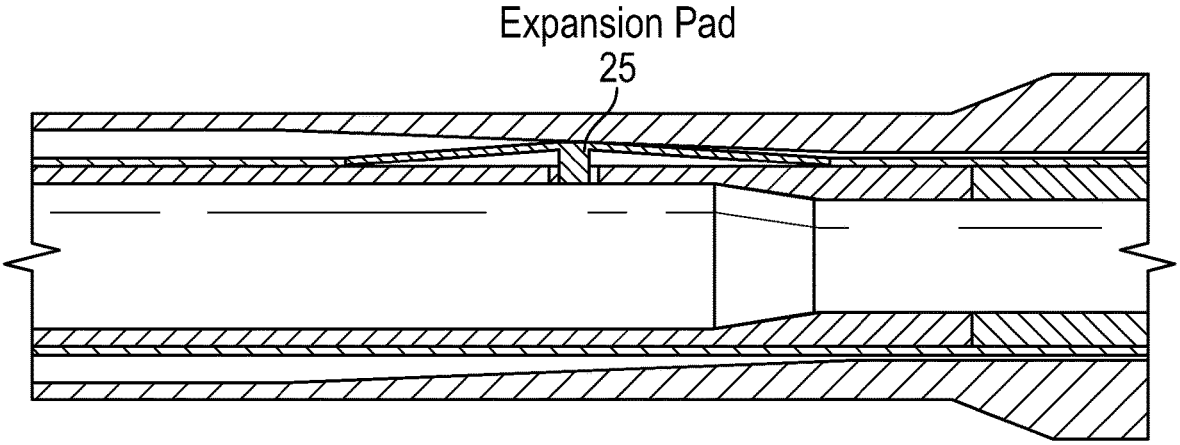

FIGS. 4A and 4B show two conditions of the expansion pads 25 of the pump down device 2 in accordance with one or more embodiments. As explained above, the main shaft 23 controls the opening of the expansion pads 25. Specifically, as shown in the drawings, when the main shaft 23 is at a locked state, the expansion pads 25 remains closed; when the main shaft 23 is at a stroked state, the expansion pads 25 are open.

As shown in FIG. 4A, the expansion pads 25 are closed. In this state, the OD of the pump down device remains smaller than the tool joint ID, and thus the pump down device 2 would continue to move downwards.

As shown in FIG. 4B, the expansion pads 25 are open. In this state, the OD of the pump down device 2 increases and is bigger than the tool joint to prevent the pump down device 2 from passing through. The expansion pads 25 are mechanically locked when the main shaft 23 stroked. In one or more embodiments, the expansion pads 25 include three pads with an interval of 120 degrees.

Figure 5A:
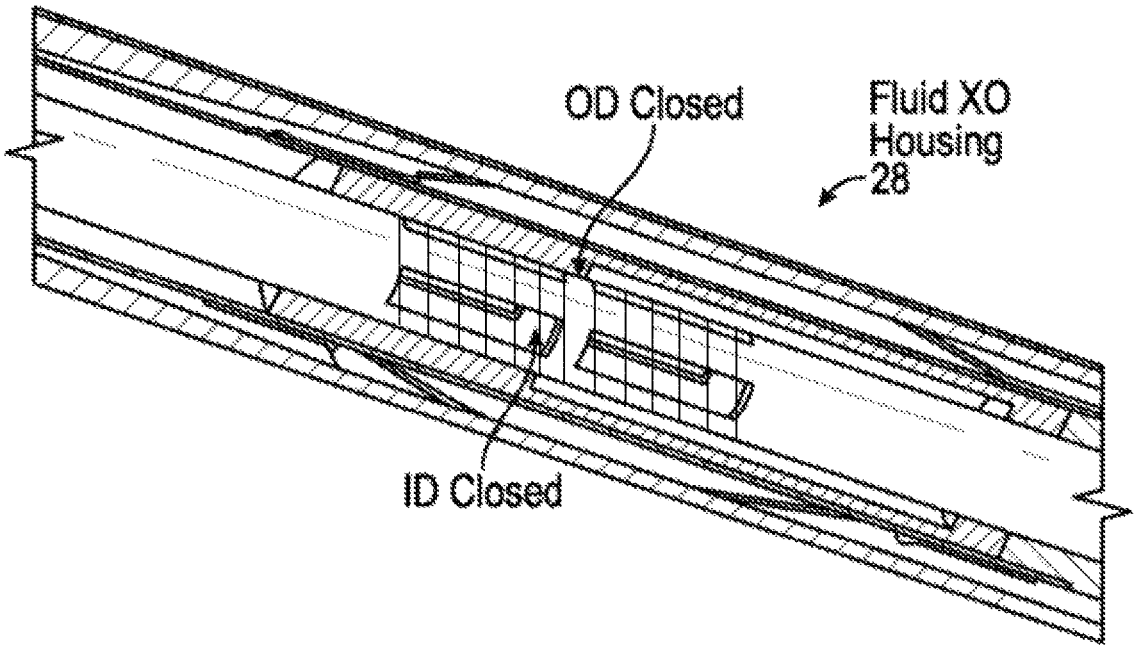
FIGS. 5A and 5B show two conditions of fluid in a pump down device in accordance with one or more embodiments.
Figure 5B:
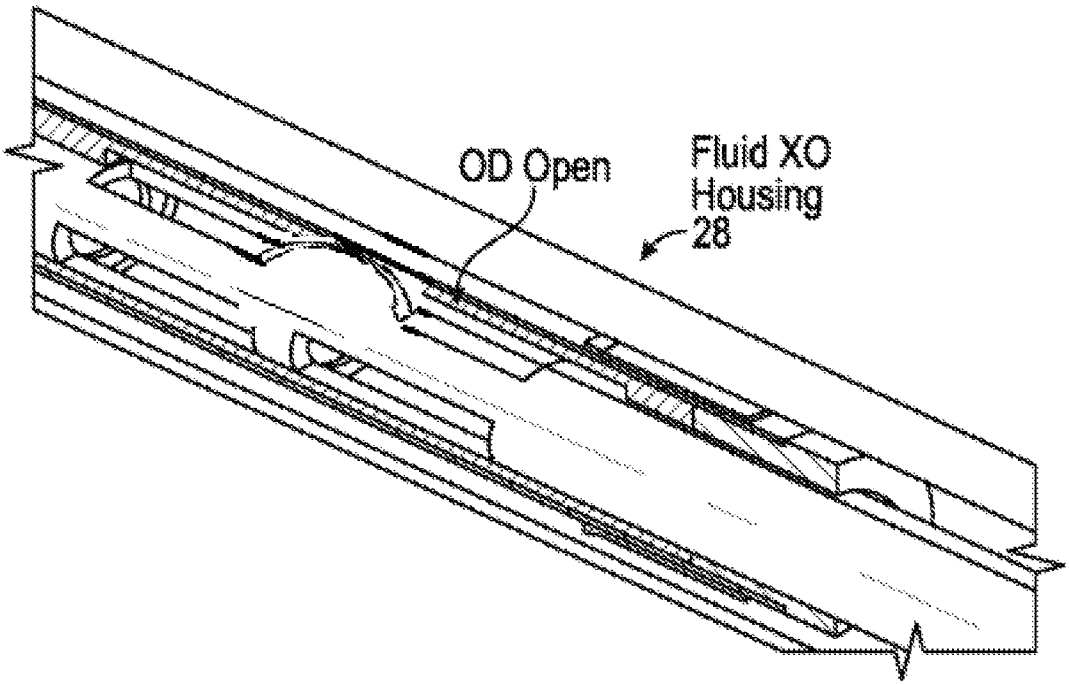

FIGS. 5A and 5B show two conditions of the main shaft 23 of the pump down device 2 in accordance with one or more embodiments.

As explained above, the main shaft 23 controls the opening of the fluid cross-over housing 28. Specifically, when the main shaft 23 is locked, no fluid flows through the fluid cross-over housing 28. When the main shaft 23 is stroked, fluid flows through the cross-over housing 28 to the hydraulic cutting head 20.

As shown in FIG. 5A, when the main shaft 23 is locked, both the ID and the OD are closed, and thus no fluid flows through the cross-over housing 28. In this state, fluid is prevented from exiting the pump down device 2 by the position of the internal tube relative to the tool body. In this state the pump down device 2 presents a closed end system, pressure is exerted on the pump down device 2 when the fluid is flowing and it is carried along the well bore with the fluid at the same rate. The working principle is similar to that of wiper plugs used in cementing operations to keep apart the different fluids.

As shown in FIG. 5B, the expansion pads 25 are open. In this state, the OD is open, and fluid flows through the cross-over housing 28.

Figure 6:
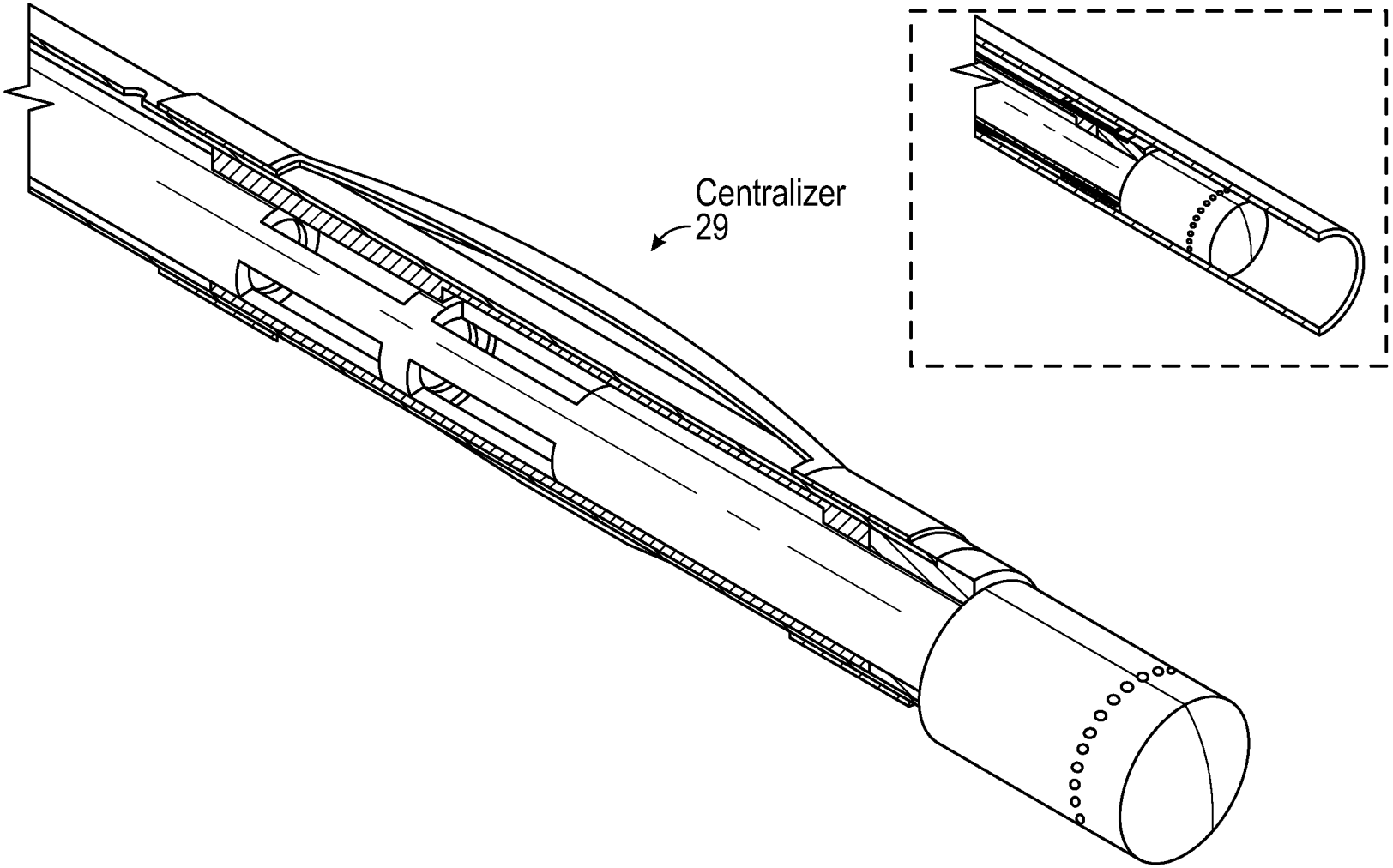
FIG. 6 shows a centralizer of a pump down device in accordance with one or more embodiments.

FIG. 6 shows a centralizer of a pump down device in accordance with one or more embodiments. One or more centralizers 29 may be used to provide friction on deployment and centralize the cutting head 30. When the main shaft strokes, as described above, the centralizers 29 provides friction to outer body that is holding the centralizers in position. Furthermore, in the process of severing the tubing wall, the centralizer 29 is required to keep the cutting head 20 in the middle of the bore and concentrate the fluid in one single area.

Figure 7:
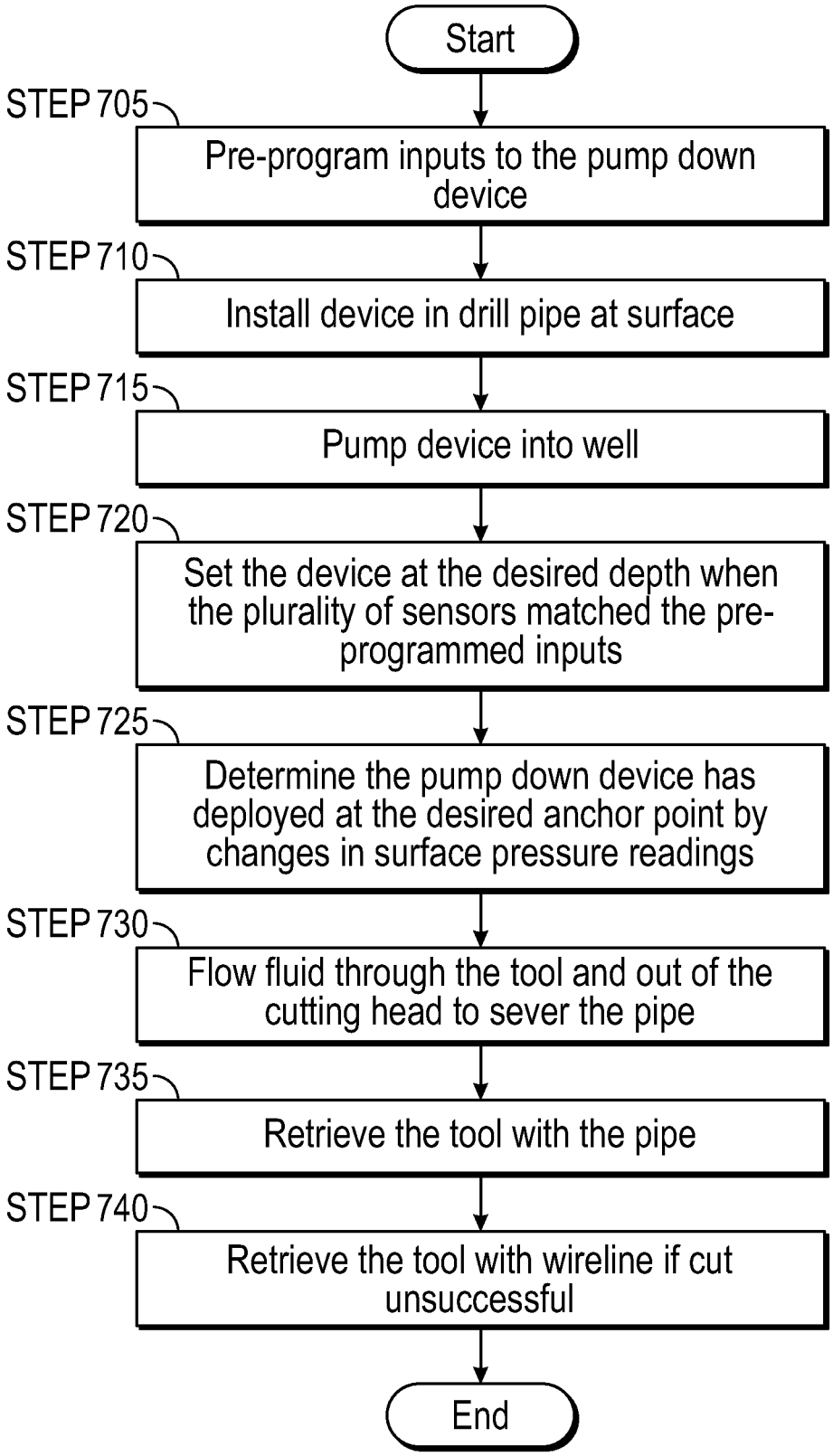
FIG. 7 shows a flowchart of an image processing method in accordance with one or more embodiments of the invention.

FIG. 7 shows a flowchart of a method for operating a pump down device in accordance with one or more embodiments of the invention. One or more of the individual processes in FIG. 7 may be performed by the pump down device 2 of FIG. 2, as described above. One or more of the individual processes shown in FIG. 7 may be omitted, repeated, and/or performed in a different order than the order shown in FIG. 2. Accordingly, the scope of the invention should not be limited by the specific arrangement as depicted in FIG. 2.

Figure 8:
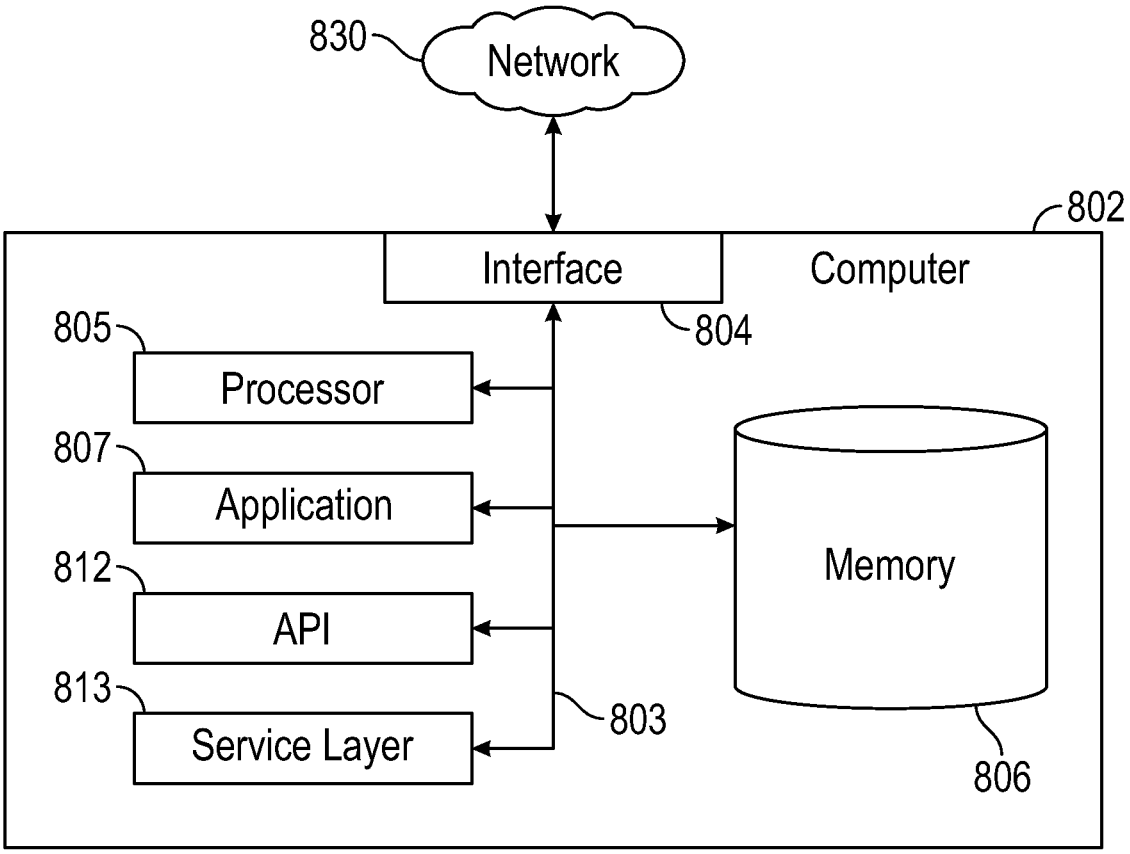
FIG. 8 shows a computing system in accordance with one or more embodiments of the invention.

At step 705, various inputs that correspond to a desired anchor point may be pre-programmed to a processor coupled to one or more sensors in the pump down device 2. The processor is shown in FIG. 8 and corresponding descriptions. These preprogrammed inputs may include a time input, a numeric input (that counts a number of tool joints passed by a Hall-effect sensor), a RFID input, and a vibration magnitude input. More specifically, in one or more embodiments, the pump down device 2 is triggered to set the anchor point at a depth of operation by at least one selected from the group consisting of: calculating a depth of the pump down device 2 in the pipe by volume/fluid displacement and based on the time input, counting a number of tool joints that are passed before release of the anchor mechanism, choosing an RFID tag to be passed by the pump down device from a plurality of embedded RFID tags in the pipe, and turning off pumps to pump fluid down the pipe after a required volume of fluid has been pumped, sending the lack of vibrational response of the tool to release the anchor mechanism after a period of time has elapsed. In one or more embodiments, corresponding to the preprogrammed inputs, one or more sensors may be installed to the electronics housing 26 of the pump down device 2. If sensors are already installed, then the processor to which the available sensors are coupled, may be preprogrammed as described above.

At step 710, the pump down device 2 is installed in a drill string/pipe (tubing 1) at the surface (i.e., the Earth's surface).

At step 715, the pump down device 2 is pumped into a well by controlling a volume of the fluid pumped. The pump down device 2 is pumped into the wellbore without the ability to freefall by controlling the volume of fluid pumped along with the pump down device. The depth reached by the pump down device may be calculated by vol/ft displacement, given the internal volume of the drill pipe as a known value.

At step 720, the pump down device 2 is determined to have reached the anchor point when the detections of the plurality of sensors match the preprogrammed inputs. That is, periodically, the applied one or more sensors, based on their types, detect changes in their environment, and send back signals to the processor. The processor then makes a determination as to whether the preprogrammed inputs match the information detected by the sensors included in the pump down device. For example, if a time is input at step 705, the pump down device 2 would be determined to have reached the desired point after the input time elapsed. In another example, at each tool joint, a determination may be made as to whether the count of the number of tool joints to pass before anchoring is met. A counter may be used to determine after which tool joint the pump down device should anchor itself.

At step 725, the anchor mechanism (expansion pads 25) is released to prevent the pump down device from going through a next tool joint when the pump down device 2 reaches the anchor point as determined in step 720. A downward motion of the main shaft locks the expansion pads 25 and a locking mechanism prevents potential unwanted upward movement and ensures that the cutting head 20 is maintained at a fixed depth. In addition, at step 725, the pump down device is determined to be deployed at the desired anchor point by changes in surface pressure readings.

At step 730, the fluid is channeled through the tool bore to the cutting head 20 to sever the pipe. A seal created at the top of the tool prevents fluid from moving past the pump down device 2 annulus with the drill pipe at the anchor point when the pump down device 2 is in operation In one or more embodiments, the pump down device 2 may be used in Heavy Weight Drill Pipe (HWDP) or other components where there is no internal upset for anchoring the pump down device 2, so an alternative anchoring mechanism will be required. In this case, when the tool unlocks the seal may be bypassed and a pressure change may be observed at surface. At this point, the pumps are stopped and the pump down device 2 is put into its setting cycle either automatically or with additional commands from surface such as some pumps on/off sequencing to confirm this is the required action. Once the alternative anchoring mechanism is set, flow would then be channeled to the cutting head 20 and the severing procedure can begin.

At step 735, when the severing operation is done, which may be indicated by a surface weight indicator that drops in value, the pump down device 2 may be retrieved along with the freed section of drill pipe and recovered at surface.

At step 740, in the event of a mis-run, the pump down device 2 can be recovered by using a slickline or wireline. By pulling on the pump down device 2 with upwards movement, the lock mechanism on the main shaft may be sheared open, and the anchor mechanism may be released. Thus, the pump down device may be retrieved from the tubing.

Embodiments of the invention may include a computer system. FIG. 8 is a block diagram of a computer system (802) used to provide computational functionalities associated with described algorithms, methods, functions, processes, flows, and procedures as described in the instant disclosure, according to an implementation. The illustrated computer (802) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (802) may include a computer that includes an input device, such as a keypad, keyboard, touch screen, or other device that can accept user information, and an output device that conveys information associated with the operation of the computer (802), including digital data, visual, or audio information (or a combination of information), or a GUI.

The computer (802) can serve in a role as a client, network component, a server, a database or other persistency, or any other component (or a combination of roles) of a computer system for performing the subject matter described in the instant disclosure. The illustrated computer (802) is communicably coupled with a network (830). In some implementations, one or more components of the computer (802) may be configured to operate within environments, including cloud-computing-based, local, global, or other environment (or a combination of environments).

At a high level, the computer (802) is an electronic computing device operable to receive, transmit, process, store, or manage data and information associated with the described subject matter. According to some implementations, the computer (802) may also include or be communicably coupled with an application server, e-mail server, web server, caching server, streaming data server, business intelligence (BI) server, or other server (or a combination of servers).

The computer (802) can receive requests over network (830) from a client application (for example, executing on another computer (802)) and responding to the received requests by processing the said requests in an appropriate software application. In addition, requests may also be sent to the computer (802) from internal users (for example, from a command console or by other appropriate access method), external or third-parties, other automated applications, as well as any other appropriate entities, individuals, systems, or computers.

Each of the components of the computer (802) can communicate using a system bus (803). In some implementations, any or all of the components of the computer (802), both hardware or software (or a combination of hardware and software), may interface with each other or the interface (804) (or a combination of both) over the system bus (803) using an application programming interface (API) (812) or a service layer (813) (or a combination of the API (812) and service layer (813). The API (812) may include specifications for routines, data structures, and object classes. The API (812) may be either computer-language independent or dependent and refer to a complete interface, a single function, or even a set of APIs. The service layer (813) provides software services to the computer (802) or other components (whether or not illustrated) that are communicably coupled to the computer (802). The functionality of the computer (802) may be accessible for all service consumers using this service layer. Software services, such as those provided by the service layer (813), provide reusable, defined business functionalities through a defined interface. For example, the interface may be software written in JAVA, C++, or other suitable language providing data in extensible markup language (XML) format or other suitable format. While illustrated as an integrated component of the computer (802), alternative implementations may illustrate the API (812) or the service layer (813) as stand-alone components in relation to other components of the computer (802) or other components (whether or not illustrated) that are communicably coupled to the computer (802). Moreover, any or all parts of the API (812) or the service layer (813) may be implemented as child or sub-modules of another software module, enterprise application, or hardware module without departing from the scope of this disclosure.

The computer (802) includes an interface (804). Although illustrated as a single interface (804) in FIG. 8, two or more interfaces (804) may be used according to particular needs, desires, or particular implementations of the computer (802). The interface (804) is used by the computer (802) for communicating with other systems in a distributed environment that are connected to the network (830). Generally, the interface (804 includes logic encoded in software or hardware (or a combination of software and hardware) and operable to communicate with the network (830). More specifically, the interface (804) may include software supporting one or more communication protocols associated with communications such that the network (830) or interface's hardware is operable to communicate physical signals within and outside of the illustrated computer (802).

The computer (802) includes at least one computer processor (805). Although illustrated as a single computer processor (805) in FIG. 8, two or more processors may be used according to particular needs, desires, or particular implementations of the computer (802). Generally, the computer processor (805) executes instructions and manipulates data to perform the operations of the computer (802) and any algorithms, methods, functions, processes, flows, and procedures as described in the instant disclosure.

The computer (802) also includes a memory (806) that holds data for the computer (802) or other components (or a combination of both) that can be connected to the network (830). For example, memory (806) can be a database storing data consistent with this disclosure. Although illustrated as a single memory (806) in FIG. 8, two or more memories may be used according to particular needs, desires, or particular implementations of the computer (802) and the described functionality. While memory (806) is illustrated as an integral component of the computer (802), in alternative implementations, memory (806) can be external to the computer (802).

The application (807) is an algorithmic software engine providing functionality according to particular needs, desires, or particular implementations of the computer (802), particularly with respect to functionality described in this disclosure. For example, application (807) can serve as one or more components, modules, applications, etc. Further, although illustrated as a single application (807), the application (807) may be implemented as multiple applications (807) on the computer (802). In addition, although illustrated as integral to the computer (802), in alternative implementations, the application (807) can be external to the computer (802).

There may be any number of computers (802) associated with, or external to, a computer system containing computer (802), each computer (802) communicating over network (830). Further, the term "client," "user," and other appropriate terminology may be used interchangeably as appropriate without departing from the scope of this disclosure. Moreover, this disclosure contemplates that many users may use one computer (802), or that one user may use multiple computers (802).

In some embodiments, the computer (802) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, and/or function as a service (FaaS).

While the disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

Although the preceding description has been described herein with reference to particular means, materials and embodiments, it is not intended to be limited to the particulars disclosed herein; rather, it extends to all functionally equivalent structures, methods and uses, such as are within the scope of the appended claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A pump down device that is deployed at an anchor point in a pipe to perform a pipe severing operation, the pump down device comprising:

a cutting head positioned at one end of the pump down device that severs the pipe;

one or more centralizers that are positioned adjacent to the cutting head and configured to provide friction for deployment of the pump down device at the anchor point and centralize the cutting head;

an electronics housing that comprises a plurality of electronic sensors; and a shaft that runs longitudinally through the pump down device, wherein the pump down device releases an anchor mechanism upon reaching the anchor point as determined by the plurality of electronic sensors based on preprogrammed inputs, and wherein the shaft pushes out a plurality of pads as the anchor mechanism that increases an outer diameter of the pump down device and prevents the pump down device from going through a next tool joint.

2. The pump down device according to claim 1, wherein the preprogrammed inputs comprise at least one selected from the group consisting of: time input, input of a number of tool joints passed, radio-frequency identification (RFID) input, and vibration input.

3. The pump down device according to claim 1, wherein the plurality of electronic sensors comprise at least one selected from the group consisting of: time sensor, magnetic sensor, RFID reader, and vibration sensor.

4. The pump down device according to claim 1, wherein the cutting head is a hydraulic cutting head.

5. The pump down device according to claim 1, wherein a downward motion of the shaft locks the plurality of pads to prevent potential unwanted upward movement and ensures that the cutting head is maintained at a constant depth.

6. The pump down device according to claim 1, wherein the anchor mechanism includes three pads with an interval of 120 degrees.

7. The pump down device according to claim 5, wherein the downward motion of the shaft opens ports within the pump down device to facilitate flow through the shaft to the cutting head.

8. The pump down device according to claim 1, wherein the pump down device includes a plurality of slips as the anchor mechanism that prevents the pump down device from going through a next tool joint.

9. The pump down device according to claim 1, wherein the cutting head is positioned at a fixed distance below the anchor point in the pipe of a joint below which has a thinnest wall thickness to cut on the joint.

10. The pump down device according to claim 1, wherein the pump down device does not land on any preinstalled anchor mechanism in the pipe and does not require a wire to reach the anchor point.

* * * * *